US011829109B2

(12) United States Patent
Kaelin

(10) Patent No.: US 11,829,109 B2
(45) Date of Patent: Nov. 28, 2023

(54) DEVICE FOR FASTENING A HOROLOGICAL EXTERNAL ELEMENT OR DISPLAY ELEMENT

(71) Applicant: ETA SA MANUFACTURE HORLOGÈRE SUISSE, Grenchen (CH)

(72) Inventor: Laurent Kaelin, Sonvilier (CH)

(73) Assignee: ETA SA MANUFACTURE HORLOGÈRE SUISSE, Grenchen (CH)

( * ) Notice: Subject to any disclaimer, the term of this patent is extended or adjusted under 35 U.S.C. 154(b) by 555 days.

(21) Appl. No.: 17/090,289

(22) Filed: Nov. 5, 2020

(65) Prior Publication Data

US 2021/0165369 A1 Jun. 3, 2021

(30) Foreign Application Priority Data

Dec. 3, 2019 (EP) ..... 19213223

(51) Int. Cl.
*G04B 19/14* (2006.01)

(52) U.S. Cl.
CPC ..... *G04B 19/14* (2013.01)

(58) Field of Classification Search
CPC ..... G04B 19/14; G04B 19/06
See application file for complete search history.

(56) References Cited

U.S. PATENT DOCUMENTS 3,523,417 A * 8/1970 Katsuhiko ..... G04B 19/14 968/157
4,183,204 A * 1/1980 Sauter ..... G04B 37/04 968/307
4,213,295 A * 7/1980 Perrot ..... G04B 19/14 968/157
4,756,654 A * 7/1988 Clough ..... F16B 37/0842 411/429
5,699,324 A * 12/1997 Perrot ..... G04B 19/14 368/294
7,313,054 B2 * 12/2007 Matthey ..... G04B 19/065 368/236

FOREIGN PATENT DOCUMENTS

CH 77 267 A 4/1918
EP 0 465 988 A1 1/1992
JP 52-95453 U 7/1977

OTHER PUBLICATIONS

European Search Report for 19 21 3223 dated Jun. 3, 2020.
Communication dated Oct. 12, 2021 from the Japanese Patent Office in Japanese Application No. 2020-184830.

* cited by examiner

*Primary Examiner* — Edwin A. Leon
*Assistant Examiner* — Jason M Collins
(74) *Attorney, Agent, or Firm* — Sughrue Mion, PLLC

(57) ABSTRACT

A device (10) for fastening an external or display element (20) onto a horological structure (100), including a retaining key (1) including a post (2) fastened to the structure (100) and a head (9) with a truncated flange (3) having a first lip (31) cooperating by bearing, in a blocking manner, with a face (41) of a fastening element (4) integral with this display element (20), which first lip (31) is delimited by non-coplanar edges (51, 52), this retaining key (1) includes, joined to each edge (51, 52) and radially retracted relative to the periphery (30) of the first lip (31), a second lip (6) having an upper surface (68) which is, at each edge (51, 52), tapered relative to the upper surface (38) of the first lip (31).

22 Claims, 5 Drawing Sheets

DEVICE FOR FASTENING A HOROLOGICAL EXTERNAL ELEMENT OR DISPLAY ELEMENT

CROSS-REFERENCE TO RELATED APPLICATIONS

This application claims priority to European Patent Application No. 19213223.1 filed Dec. 3, 2019, the entire contents of which are incorporated herein by reference.

Field of the Invention

The invention relates to a device for fastening an external or display element onto a horological structure, comprising at least one retaining key comprising a post arranged so as to be driven or screwed or riveted or brazed or welded into a recess comprised in said structure or comprised in an element fixed to said structure, said at least one retaining key comprising a head with at least one truncated flange that is substantially axisymmetric relative to the axis of said post, the direction of said axis defining the direction in which a said external or display element is inserted relative to said structure, said truncated flange comprising a substantially axisymmetric part which extends about an angular sector of strictly less than 360°, and said truncated flange comprising at least one first lip delimited by a first upper surface and a first lower surface and which is arranged so as to cooperate by bearing, in a blocking manner, with a surface or a face comprised in a fastening element integral with a said external or display element, and which first lip is further delimited at the two ends thereof by edges.

The invention relates to the field of fastening external or display elements in a timepiece, in particular a watch. It in particular relates to the fastening of dials.

BACKGROUND OF THE INVENTION

In order to fasten a horological external or display element such as a dial comprising dial feet, dial keys are used to retain these feet by deformation, such dial keys comprising a vertically truncated and skewed flange, the edge whereof allows for good penetration into the cylindrical part of the dial foot, thus allowing for the immobilisation thereof. However, the rotation of such a dial key generally generates, during the rotation thereof to fasten the dial, a burr originating from the dial foot concerned and which can easily become detached.

SUMMARY OF THE INVENTION

To prevent such a burr from being generated and potentially falling into and polluting the movement, the invention relates to a fastening device comprising a new retaining key, which is obliquely truncated and angled to the origin of attack of the dial foot, the material of the dial foot whereof can thus be repelled and not cut, with the clot thus created remaining attached to the component.

For this purpose, the invention relates to a fastening device according to the claim 1.

The invention further relates to a timepiece, in particular a watch, comprising at least one such fastening device.

BRIEF DESCRIPTION OF THE DRAWINGS

Other features and advantages of the invention will be better understood upon reading the following detailed description given with reference to the accompanying drawings, in which.

DETAILED DESCRIPTION OF THE PREFERRED EMBODIMENTS

Figure 1:
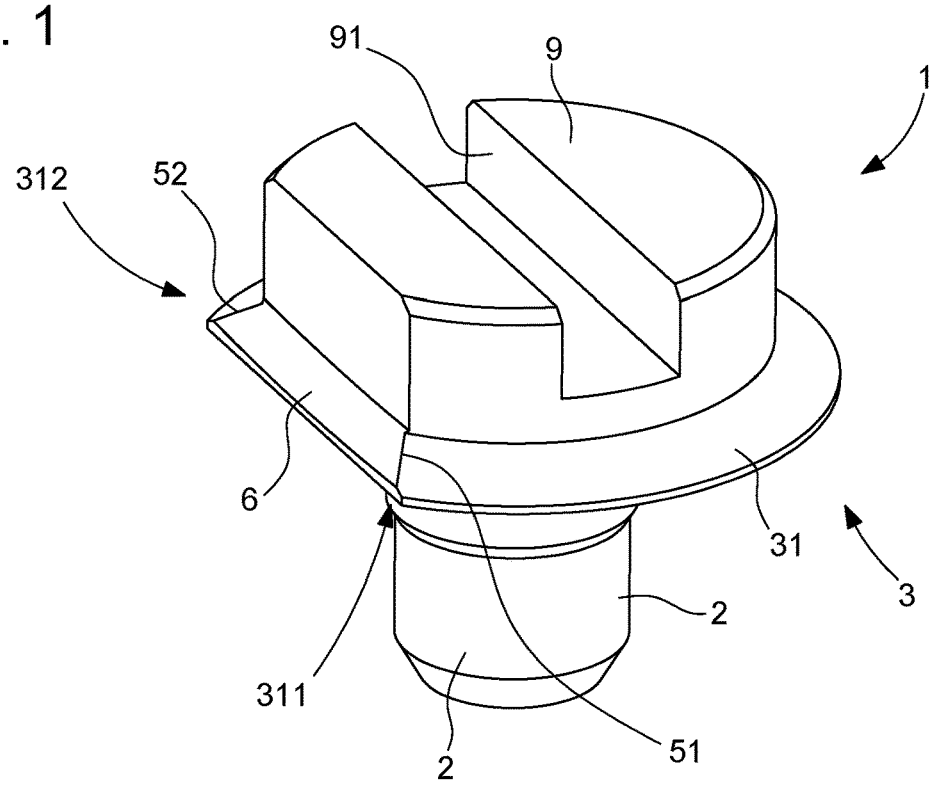
FIG. 1 diagrammatically shows a perspective view of a retaining key comprised in a fastening device according to the invention; this retaining key comprises a truncated flange with a first conical lip, and a second oblique lip.
Figure 2:
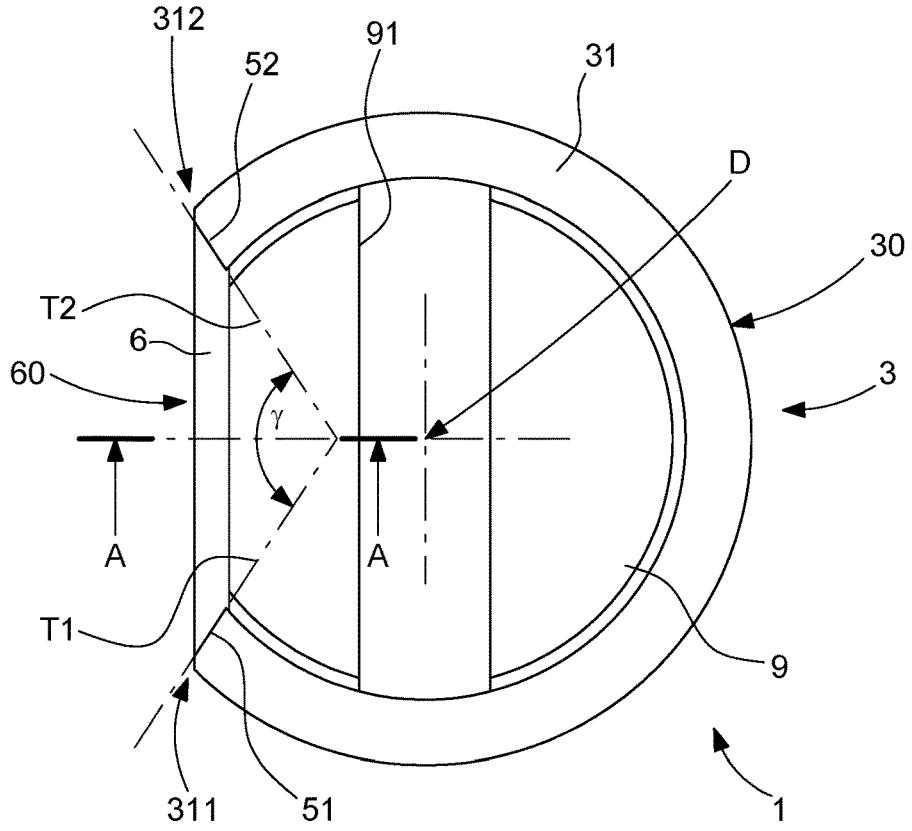
FIG. 2 diagrammatically shows an overhead view of the retaining key in FIG. 1.
Figure 3:
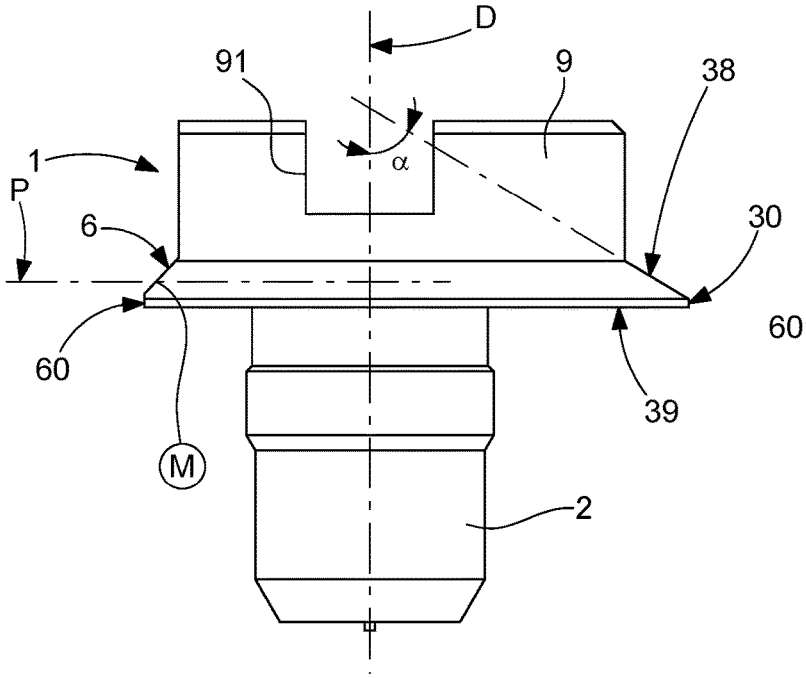
FIGS. 3 and 4 diagrammatically show a side view, in two perpendicular directions, of the retaining key in FIG. 1.
Figure 5:
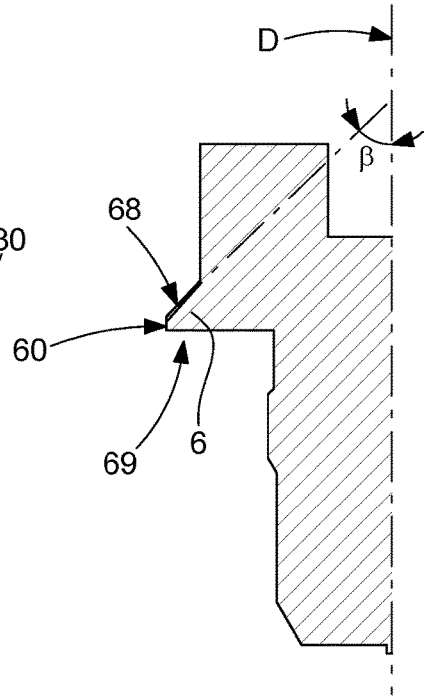
FIG. 5 diagrammatically shows a sectional view along the line AA in FIG. 2 of a feature of the retaining key in FIG. 1.
Figure 4:
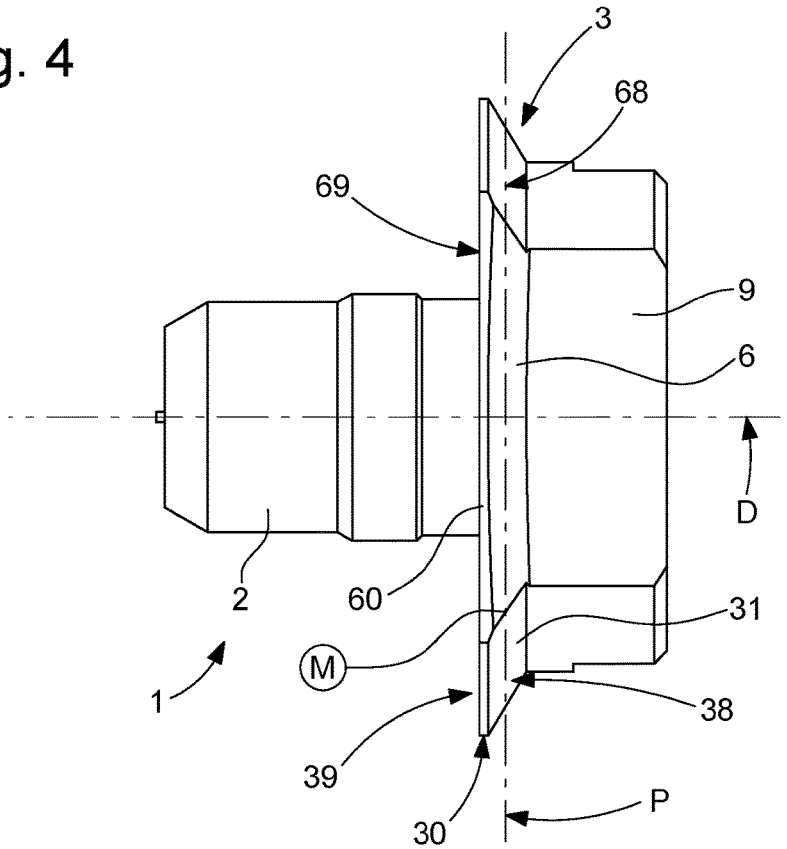

The invention relates to a device 10 for fastening an external or display element 20 onto a horological structure 100.

This fastening device 10 comprises at least one retaining key 1, which comprises a post 2, which is arranged so as to be driven or screwed or riveted or brazed or welded into a recess 8 comprised in the structure 100 or comprised in an element fixed to the structure 100, or on the structure 100 or such a fixed element. This retaining key 1 comprises a head 9, with at least one truncated flange 3 which is substantially axisymmetric relative to the axis D of the post 2. The direction of this axis D defines the direction in which an external or display element 20 is inserted relative to the structure 100.

The truncated flange 3 comprises a substantially axisymmetric part which extends about an angular sector of strictly less than 360°, and this truncated flange 3 comprises at least one first lip 31, which is delimited by a first upper surface 38 and a first lower surface 39, and which is arranged so as to cooperate, by bearing thereagainst in a blocking manner, with a surface 42 or a face 41, which is cylindrical or otherwise, comprised in a fastening element 4 integral with an external or display element 20.

In a first specific alternative embodiment, the first lower surface 39 is planar.

In another specific alternative embodiment, the first lower surface 39 is helix-shaped, with a very low pitch, in the order of a few hundredths of a millimetre, or even a tenth of a millimetre. This alternative embodiment ensures good retention on a planar surface 42 of the fastening element 4, such as a groove face or even a front surface of a dial, or similar.

This first lip 31 is delimited at the ends 311, 312 thereof by edges 51, 52.

According to the invention, and as shown in FIGS. 1 to 5, these edges 51 and 52 are not coplanar, and this retaining key 1 comprises, joined to each edge 51, 52, and radially retracted relative to the first periphery 30 of the first lip 31, a second lip 6. This second lip 6 comprises a second lower surface 69, which is shared with the first lower surface 39, and a second upper surface 68 which is, at each edge 51, 52, tapered relative to the first upper surface 38 of the first lip 31.

More particularly, the edges 51, 52 are finely angled edges, and are in particular radius edges with a radius that lies in the range 10 micrometres to 30 micrometres.

More particularly, the first lip 31 is more resilient than the fastening element 4 with which it is arranged to cooperate, and this first lip 31 is arranged to repel the material of the fastening element 4 during a relative rotation of the retaining key 1 relative to this fastening element 4. Preferably, the first lip 31 has a hardness of greater than or equal to 550 HV; more particularly, this retaining key 1 is made of steel.

Figure 6:
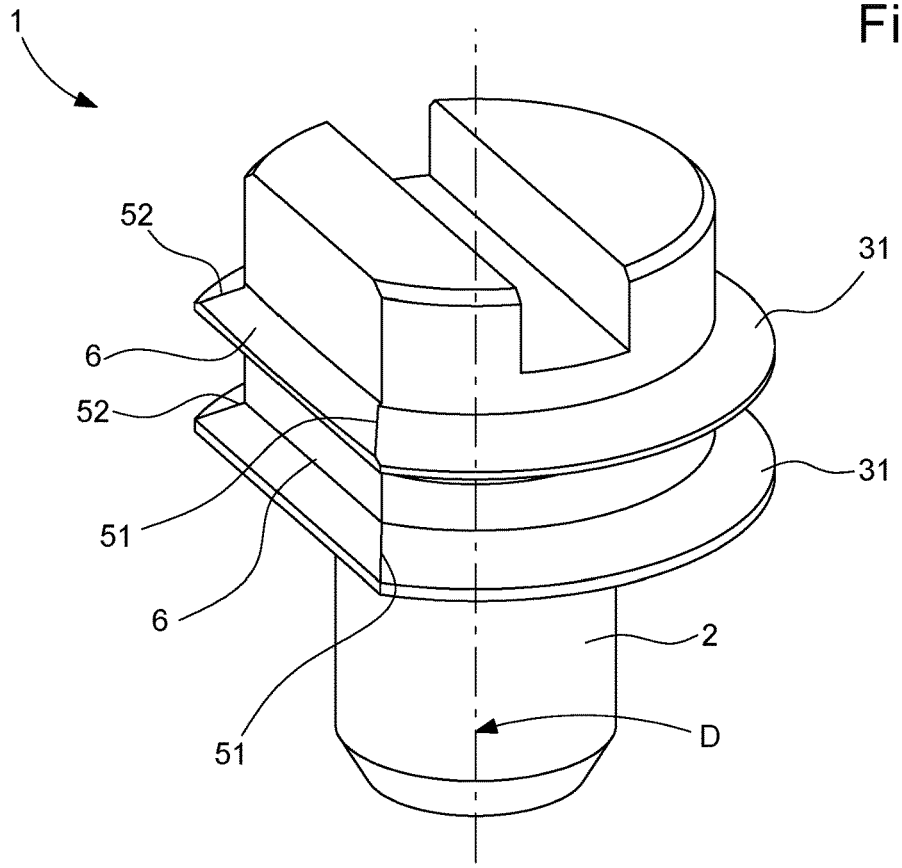
FIG. 6 diagrammatically shows a perspective view of an alternative embodiment of a retaining key comprising two superimposed flanges.

In another specific alternative embodiment, and as shown in FIG. 6, the retaining key 1 comprises a plurality of truncated flanges 3, which are superimposed in the direction of the axis D, and capable of applying different bearing points on the same fastening element 4. These superimposed lips procure different bearing points, either a plurality of bearing points on a cylindrical face of a dial foot for example, or both a bearing point with a planar surface of one of the lips against an upper surface of a dial for example, combined with another bearing point of another lip on a cylindrical face of a dial foot. It should be noted that, in the preferred application for fastening a dial foot, the dial foot must bear facing the lip, to prevent plastic deformation of the dial foot under bending.

Figure 7:
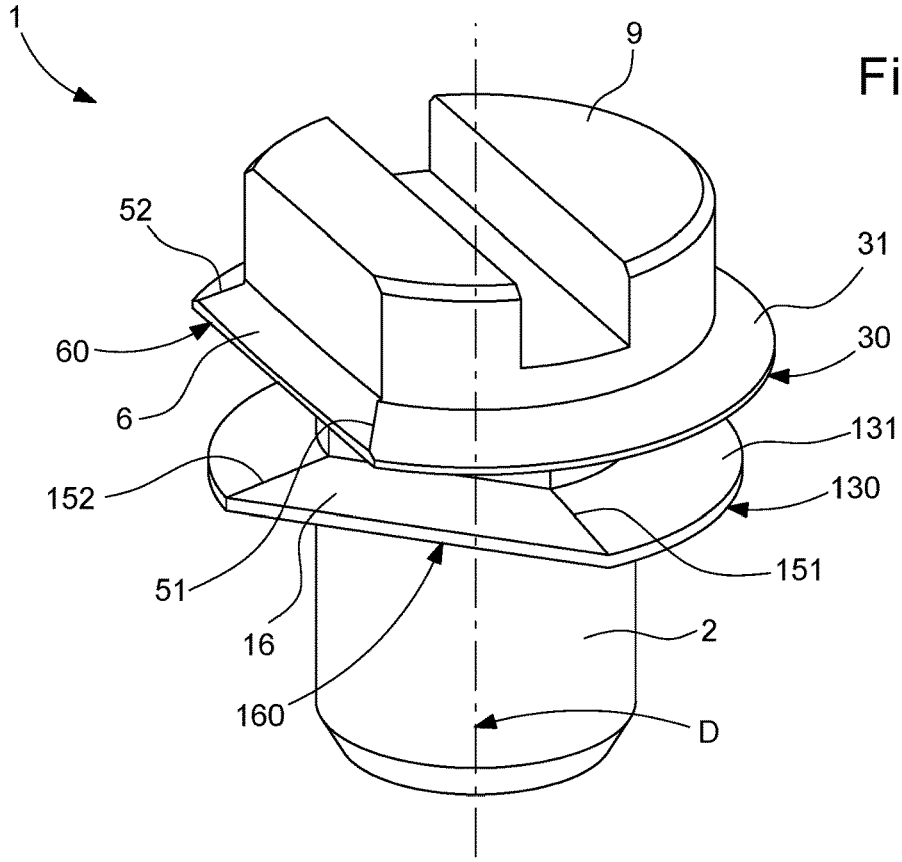
FIG. 7 diagrammatically shows a perspective view of another alternative embodiment of a retaining key comprising two superimposed, angularly offset flanges.
Figure 8:
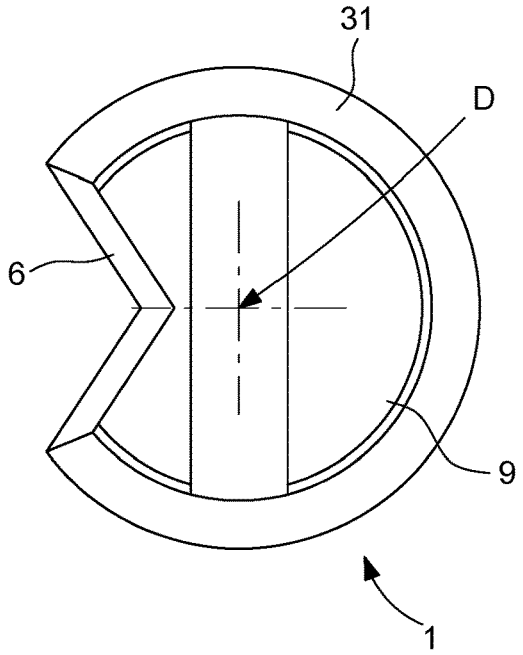
FIGS. 8 and 9 diagrammatically show an overhead view of other alternative embodiments of retaining keys according to the invention.

In another specific alternative embodiment, and as shown in FIG. 7, a plurality of truncated flanges 3 comprise first lips 31, 131, the edges 51, 52, respectively 151, 152 whereof are angularly offset relative to one another. Such angularly offset origins of attack thus allow the fastening element 4 to be tightened gradually; this disposition further guarantees good resistance during successive disassembly operations, which clockmakers always carry out by targeting another point of the dial foot.

More particularly, the first upper surface 38 is conical with a first half apex angle $\alpha$, relative to the axis D, which lies in the range 110° to 130°. The more acute the angle of each lip, the easier the penetration into the fastening element, in particular a dial foot or similar, at the expense of the resistance of the lip; conversely, penetration would require too much torque and would tend to bend this fastening element, in particular a dial foot.

More particularly, along a cross-section in each radial plane passing through the axis D, the second upper surface 68 forms, with the axis D, a second angle $\beta$, which lies in the range 40° to 50°.

More particularly, in a plane P perpendicular to the axis D, and at an edge 51, 52, the dihedron tangent to the first upper surface 38 and to the second upper surface 68 has a third angle that lies in the range 145° to 165°.

In the general case, the retaining key 1 is arranged so as to be used in both directions of rotation.

In one specific case, the retaining key 1 is arranged so as to be used in a single direction of rotation, and comprises a first lip 31 in the shape of a helix over less than one revolution, in particular extending about an angle of less than 240° and with a pitch of less than 300 micrometres, however without being limited thereto. In the application for fastening a dial, this alternative embodiment has the advantage of pulling the dial against the bearing point thereof through the dial feet, managing the torque transmitted to the keys to avoid being torn away; it goes without saying that, in order for the dial foot to engage in a contactless manner, a non-threaded area must be provided, which explains the angle of less than one revolution.

More particularly, and as shown in the figures, the first lower surface 39 is planar.

More particularly, and as shown in the figures, the second upper surface 68 is planar.

Figure 9:
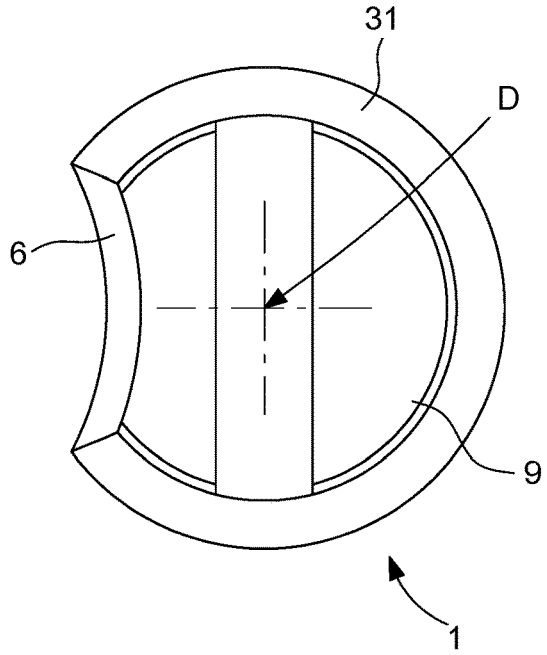
Figure 10:
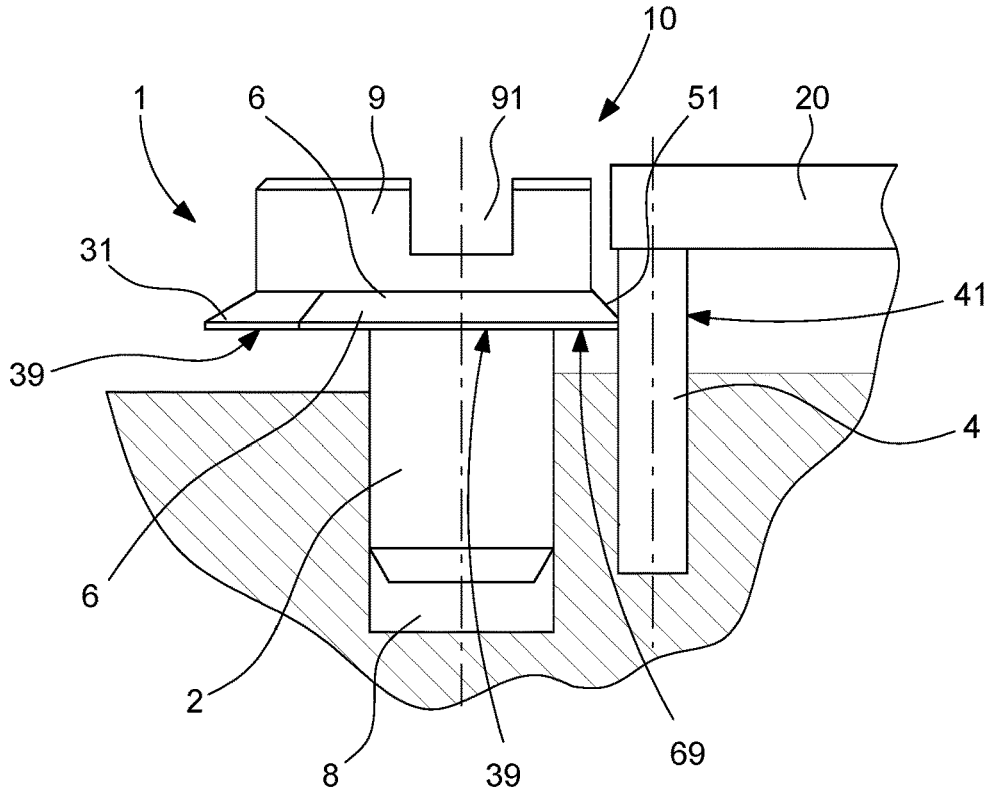
FIG. 10 diagrammatically shows a sectional view of the retaining key in FIG. 1 cooperating with a dial foot by locally repelling the material thereof, in order to fasten a dial onto a structure.
Figure 11:
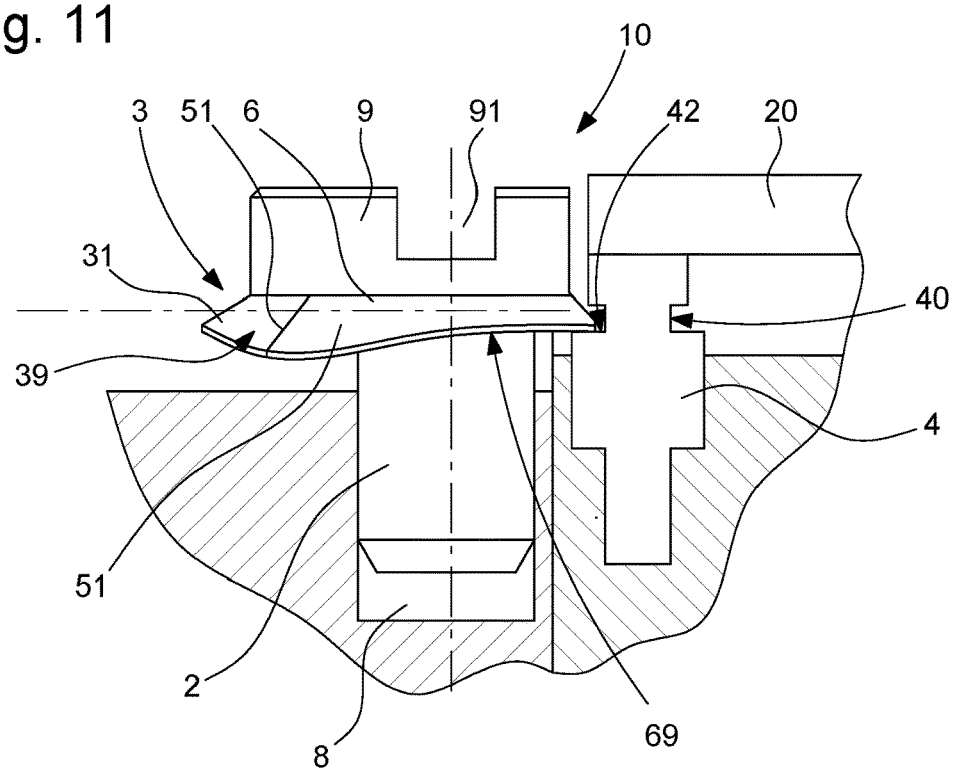
FIG. 11 diagrammatically shows a sectional view of the retaining key in FIG. 1 cooperating with a dial foot by bearing against a groove comprised therein, in order to fasten a dial onto a structure.
Figure 12:
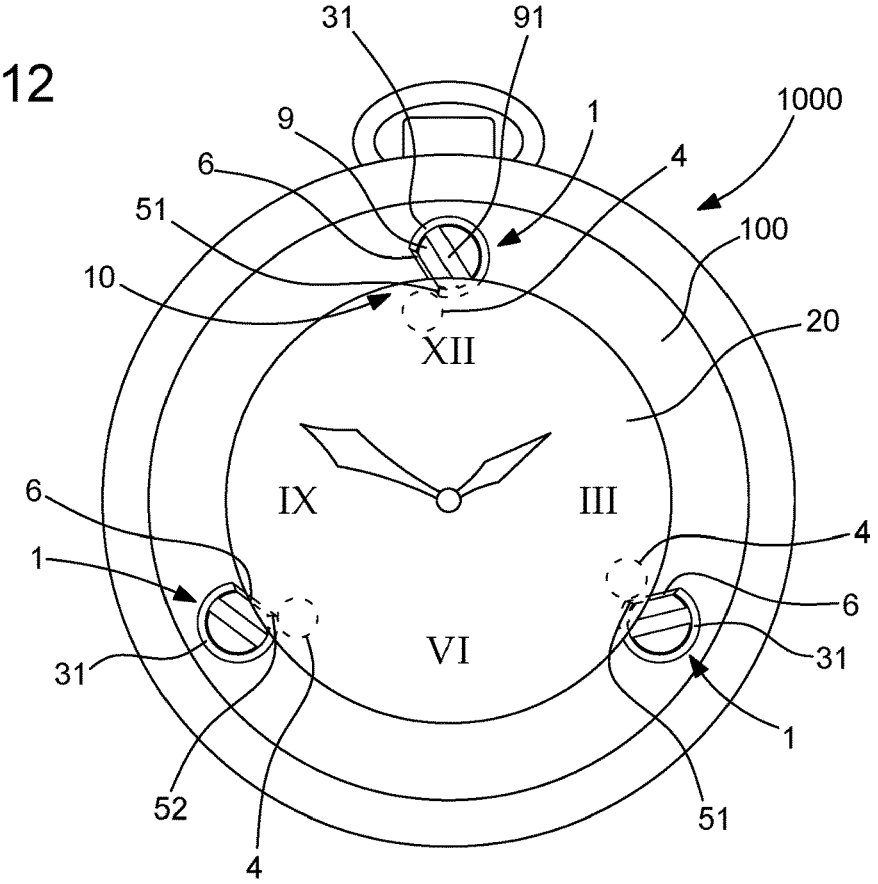
FIG. 12 diagrammatically shows a front view of a timepiece, in this case a watch, comprising a structure supporting a dial, assembled by a fastening device according to the invention, comprising three retaining keys according to FIG. 1.

In an alternative embodiment, and as shown in FIG. 9, the second upper surface 68 is concave. More specifically, it is understood that it is important for this truncated surface 6 to escape the cooperation with the foot, and it can take any form, provided that the interface areas at the edges 51 and 52 perform the function of repelling the material at the fastening element 4.

More particularly, when projected on a plane perpendicular to the axis D, the tangents T1, T2, to the edges 51, 52 at the ends of the edges 51, 52, joined with the first periphery 30 of the first lip 31, form with one another a fourth angle Y which lies in the range 90° to 130°.

More particularly, the first periphery 30 of the first lip 31 is a wire edge, the thickness whereof is less than or equal to 35 micrometres.

More particularly, the second lip 6 comprises a second periphery 60, which is a wire edge, the thickness whereof is less than or equal to 35 micrometres.

More particularly, the external or display element 20 is a dial, the retaining key 1 is a dial key, and the fastening element 4 is a dial foot or a part of the dial.

The invention further relates to a timepiece 1000, in particular a watch, comprising a structure 100 comprising at least one recess 8 for receiving a post, at least one external or display element 20 comprising at least one fastening element 4, and at least one such fastening device 10 for fastening an external or display element 20 onto the structure 100 or onto an element fixed to the structure 100.

More particularly, at least one external or display element 20 comprises a side visible to the user, and each retaining key 1 can be inserted into the structure 100 or into an element fixed to the structure 100 and accessible from the visible side, and comprises a drive surface 91 for inserting a tool capable of causing the retaining key to rotate about the axis D.

More particularly, at least one external or display element 20 and a retaining key 1 arranged so as to block this external or display element 20 are fastened on separate elements, each fixed to the structure 100.

More particularly, at least one fastening element 4 for fastening an external or display element 20 comprises a groove 40, which is arranged so as to cooperate with the first lip 31 of a retaining key 1 arranged so as to block this external or display element 20.

More particularly, at least one retaining key 1 is partially concealed, from the visible side, by the external or display element 20 blocked by the retaining key 1.

Such a retaining key 1 can be used for a plurality of dial or similar assembly and disassembly operations.

In the application for fastening a dial using a dial key, the first lip 31 penetrates a cylindrical face of the dial foot, is rigid, and must not be deformed, the base material thereof is in particular a steel, with in particular a hardness of 550 to 670 HV, however without being limited thereto.

In an alternative embodiment of the dial foot 4 comprising a groove 40, the first lip 31 can come to bear against one of the faces of this groove 40. In other cases, the first lip 31 must deform the dial foot, since without the deformation thereof, resistance is not guaranteed.

To summarise, the invention prevents the generation of detachable burrs, and ensures that the horological movement is kept clean when fastening external or display elements.

The invention claimed is:

1. A device (10) for fastening an external or display element (20) onto a horological structure (100), comprising at least one retaining key (1) comprising a post (2) arranged so as to be driven or screwed or riveted or brazed or welded into a recess (8) comprised in said structure (100) or comprised in an element fixed to said structure (100), said at least one retaining key (1) comprising a head (9) with at least one truncated flange (3) that is substantially axisymmetric relative to the axis (D) of said post (2), the direction of said axis (D) defining the direction in which a said external or display element (20) is inserted relative to said structure (100), said truncated flange (3) comprising a substantially axisymmetric part which extends about an angular sector of strictly less than 360°, and said truncated flange (3) comprising at least one first lip (31) delimited by a first upper surface (38) and a first lower surface (39) and which is arranged so as to cooperate by bearing, in a blocking manner, with a surface (42) or a face (41) comprised in a fastening element (4) integral with a said external or display element (20), and which first lip (31) is further delimited at a first end (311) thereof and a second end (312) thereof by a respective first edge (51) and a respective second edge (52), wherein said first and second edges (51, 52) are not coplanar, wherein said at least one retaining key (1) comprises, joined to each said first and second edge (51, 52) and radially retracted relative to a first periphery (30) of said first lip (31), a second lip (6) comprising a second lower surface (69) shared with said first lower surface (39), and a second upper surface (68) which is, at each said first and second edge (51, 52), tapered relative to said first upper surface (38).

2. The fastening device (10) according to claim 1, wherein said first and second edges (51, 52) are radius edges with a radius that lies in the range 10 micrometres to 30 micrometres.

3. The fastening device (10) according to claim 1, wherein said first lip (31) is more resilient than said fastening element (4) with which it is arranged to cooperate, and is arranged to repel the material of said fastening element (4) during a relative rotation of said retaining key (1) relative to said fastening element (4), and wherein said first lip (31) has a hardness of greater than or equal to 550 HV.

4. The fastening device (10) according to claim 1, wherein said retaining key (1) comprises a plurality of said truncated flanges (3) superimposed in the direction of said axis (D), capable of applying different bearing points on the same said fastening element (4).

5. The fastening device (10) according to claim 4, wherein a plurality of said truncated flanges (3) comprise said first lips (31), said first and second edges (51, 52) whereof are angularly offset relative to one another.

6. The fastening device (10) according to claim 1, wherein said first upper surface (38) is conical with a first half apex angle (α), relative to said axis (D), lying in the range 110° to 130°.

7. The fastening device (10) according to claim 1, wherein, along a cross-section in each radial plane passing through said axis (D), said second upper surface (68) forms, with the axis D, a second angle (β) lying in the range 40° to 50°.

8. The fastening device (10) according to claim 1, wherein, in a plane (P) perpendicular to said axis (D), and at said first and second edges, a dihedron tangent to said first upper surface (38) and to said second upper surface (68) has a third angle lying in the range 145° to 165°.

9. The fastening device (10) according to claim 1, wherein said retaining key (1) is arranged so as to be used in both directions of rotation.

10. The fastening device (10) according to claim 1, wherein said retaining key (1) is arranged so as to be used in a single direction of rotation, and comprises a said first lip (31) in the shape of a helix over less than one revolution, extending about an angle of less than 240° and with a pitch of less than 300 micrometres.

11. The fastening device (10) according to claim 1, wherein said first lower surface (39) is planar.

12. The fastening device (10) according to claim 1, wherein said second upper surface (68) is planar.

13. The fastening device (10) according to claim 1, wherein said second upper surface (68) is concave.

14. The fastening device (10) according to claim 1, wherein, when projected on a plane perpendicular to said axis (D), the tangents (T1, T2) to said edges (51, 52) at the first and second ends of said first and second edges (51, 52), joined with the first periphery (30) of said first lip (31), form with one another a fourth angle (y) which lies in the range 90° to 130°.

15. The fastening device (10) according to claim 1, wherein said first periphery (30) of said first lip (31) is a wire edge, the thickness whereof is less than or equal to 35 micrometres.

16. The fastening device (10) according to claim 1, wherein said second lip (6) comprises a second periphery (60), which is a wire edge, the thickness whereof is less than or equal to 35 micrometres.

17. The fastening device (10) according to claim 1, wherein said external or display element (20) is a dial, and wherein said retaining key (1) is a dial key, and wherein said fastening element (4) is a dial foot or a part of said dial.

18. A timepiece (1000) comprising a structure (100) comprising at least one recess (8) for receiving a post, at least one external or display element (20) comprising at least one fastening element (4), and at least one fastening device (10) according to claim 1 for fastening a said external or display element (20) onto said structure (100) or onto an element fixed to said structure (100).

19. The timepiece (1000) according to claim 18, wherein at least one said external or display element (20) comprises a side visible to the user, and wherein each said retaining key (1) can be inserted into said structure (100) or into an element fixed to said structure (100) and accessible from said visible side, and comprises a drive surface (91) for inserting a tool capable of causing said retaining key to rotate about said axis (D).

20. The timepiece (1000) according to claim 18, wherein at least one said external or display element (20) and a said retaining key (1) arranged so as to block this external or display element (20) are fastened on separate elements, each fixed to said structure (100).

21. Timepiece (1000) according to claim 18, wherein at least one fastening element (4) for fastening a said external or display element (20) comprises a groove (40) arranged so as to cooperate with said first lip (31) of a said retaining key (1) arranged so as to block this external or display element (20).

22. The timepiece (1000) according to claim 19, wherein at least one said retaining key (1) is partially concealed, from said visible side, by the said external or display element (20) blocked by said retaining key (1).

* * * * *